US011162274B2

(12) United States Patent
Brock

(10) Patent No.: US 11,162,274 B2
(45) Date of Patent: Nov. 2, 2021

(54) CATCH FENCE SYSTEM

(71) Applicant: Terry Brock, Loveland, OH (US)

(72) Inventor: Terry Brock, Loveland, OH (US)

( * ) Notice: Subject to any disclaimer, the term of this patent is extended or adjusted under 35 U.S.C. 154(b) by 187 days.

(21) Appl. No.: 16/742,361

(22) Filed: Jan. 14, 2020

(65) Prior Publication Data

US 2020/0224449 A1 Jul. 16, 2020

Related U.S. Application Data

(60) Provisional application No. 62/792,520, filed on Jan. 15, 2019.

(51) Int. Cl.

| | |
|---|---|
| ***E04H 17/08*** | (2006.01) |
| ***E01F 15/14*** | (2006.01) |
| ***E04H 17/10*** | (2006.01) |
| ***E01F 15/06*** | (2006.01) |
| ***A63K 3/00*** | (2006.01) |

(52) U.S. Cl.

CPC ..... *E04H 17/08* (2013.01); *A63K 3/00* (2013.01); *E01F 15/06* (2013.01); *E01F 15/146* (2013.01); *E04H 17/10* (2013.01)

(58) Field of Classification Search

CPC ..... E04H 17/10; E04H 17/12; E04H 17/124; E04H 17/08; E04H 17/009; E04H 17/22; E04H 17/20; E04H 17/23; E01F 7/04; E01F 7/045; E01F 15/06; E01F 15/14; E01F 15/145; E01F 15/146

See application file for complete search history.

(56) References Cited

U.S. PATENT DOCUMENTS 557,669 A * 4/1896 Guthrie ..... E04H 17/08 256/35
1,788,309 A * 1/1931 Landis ..... E01F 15/06 248/66
1,857,435 A * 5/1932 Cole ..... E01F 15/06 256/13.1
1,970,737 A * 8/1934 Cole ..... E04H 17/10 248/66

(Continued)

FOREIGN PATENT DOCUMENTS

AT 190543 B * 7/1957 ..... B64C 25/62
CA 2406361 A1 * 4/2004 ..... E01F 15/06

(Continued)

*Primary Examiner* — Jonathan P Masinick
(74) *Attorney, Agent, or Firm* — Wood Herron & Evans LLP

(57) ABSTRACT

A catch fence system for use at a race track having a retaining wall. The catch fence system includes first and second frame members with each having a lower front member with a mounting bracket adapted to connect the lower front member to the retaining wall. A first support ring is affixed to the lower front member of the first frame member and a second support ring is affixed to the lower front member of the second frame member. A first front cable extends through the first and second support rings. A first stop block is affixed to first front cable to the outside of and a distance L1 from the first support ring and a second stop block is affixed to the first front cable to the outside of and a distance L2 from the second support ring, wherein the distance L2 is greater than the distance L1.

19 Claims, 17 Drawing Sheets

(56) References Cited

U.S. PATENT DOCUMENTS

| | | | | | |
|---|---|---|---|---|---|
| 2,074,771 | A * | 3/1937 | Brickman | E01F 15/06 | 256/13.1 |
| 2,321,988 | A * | 6/1943 | Brickman | E01F 15/06 | 256/13.1 |
| 5,822,918 | A * | 10/1998 | Helfman | A47H 27/00 | 47/39 |
| 5,984,249 | A * | 11/1999 | Cohen | A47G 7/044 | 108/47 |
| 6,347,489 | B1 * | 2/2002 | Marshall, Jr. | E02D 27/00 | 248/354.5 |
| 8,561,355 | B2 * | 10/2013 | Canavarro | E04B 2/7416 | 52/36.1 |
| 2003/0213946 | A1 * | 11/2003 | Alberson | E01F 15/0476 | 256/13.1 |
| 2003/0215305 | A1 * | 11/2003 | Alberson | F16B 2/065 | 411/400 |
| 2005/0045785 | A1 * | 3/2005 | Cohen | F16B 2/12 | 248/214 |
| 2006/0022189 | A1 * | 2/2006 | Collins, IV | E04H 12/2261 | 256/65.14 |
| 2013/0126810 | A1 * | 5/2013 | Wynnytsky | E01F 15/065 | 256/13.1 |
| 2014/0312289 | A1 * | 10/2014 | Harris | F16B 2/06 | 256/13.1 |
| 2018/0320405 | A1 * | 11/2018 | Matthews | E04H 17/16 | |

FOREIGN PATENT DOCUMENTS

| | | | | |
|---|---|---|---|---|
| CH | 302852 A * | 11/1954 | E01F 7/04 | |
| CH | 603911 A5 * | 8/1978 | E01F 7/04 | |

* cited by examiner

CATCH FENCE SYSTEM

CROSS-REFERENCE TO RELATED APPLICATIONS

The present application claims priority to U.S. Provisional Patent Application No. 62/792,520 filed Jan. 15, 2019, the disclosure of which is hereby incorporated herein by reference in its entirety.

FIELD OF THE INVENTION

The invention relates generally to catch fences for motorsports.

BACKGROUND OF THE INVENTION

Auto racing often involves crashes of one or more cars. Under certain circumstances, cars involved in the crash will strike the concrete retaining wall circling the outer part of the racetrack. To minimize injuries to drivers impacting the solid concrete wall, a safer barrier was developed and installed on retaining walls at the Indianapolis Motor Speedway in 2002. Since then there have been no fatalities or serious injuries associated with safer barrier impacts.

The cars involved in the crash may also elevate off the racetrack and impact the catch fence. Unfortunately, current catch fence designs have not been optimized to minimize injury to drivers. Consequently, there have been fatalities and serious injuries to drivers when they impact the catch fences in motorsports. In addition, there have been injuries to fans as well.

Catch fences in motorsports today are little more than a barrier. They are a threat to the safety of the driver and the fans when they are impacted. Typical catch fences utilize the three main components: vertical columns, horizontal cables, and fencing. The design of current catch fences, however, have deficiencies. For example, current catch fences use vertical columns that are straight up or angled toward the track. In addition, the current catch fences normally follow the contour of the wall resulting in the columns near the apex of a turn being angled toward the track. This design contains the car and protects the fans, but the fans are not protected if a car is destroyed in front of them. When a car becomes airborne near the apex of a turn it encounters columns that are extended out over the track. The result is the same as it would be if it was still on the track if the barrier included columns angled inward when impacted.

SUMMARY OF THE INVENTION

To these and other ends, a catch fence system for use at a race track having a retaining wall bordering at least a portion of the race track is disclosed. In one embodiment, the catch fence system includes first and second frame members spaced apart from each other, where each of the first and second frame members has a lower front member and a rear member. The lower front member has a mounting bracket that is adapted to connect the lower front member to the retaining wall. The rear member is adapted to be connected to a support surface. A first support ring is affixed to the lower front member of the first frame member and a second support ring is affixed to the lower front member of the second frame member. A first front cable extends between and slidingly through the first and second support rings. A first stop block is affixed to the first front cable to the outside of the first support ring and a second stop block affixed to the first front cable to the outside of second support ring. A front fence extends between each lower front member and is affixed to the first front cable. The first stop block is positioned along the first front cable a distance L1 from the first support ring and the second stop block is positioned along the first front cable a distance L2 from the second support ring, wherein the distance L2 is greater than the distance L1.

In one embodiment, the catch fence system further includes a rear cable extending between and affixed to the rear member of the first and second frame members and a rear fence extending between the first and second frame members and is affixed to the rear cable.

In one aspect, the lower front member of each of the first and second frame members is tilted rearwardly away from the race track. In another aspect, each of the first and second frame members has an upper front member tilting forwardly towards the race track.

In one embodiment, each of the first and second frame members has an upper front member and the catch fence system further includes a third support ring affixed to the upper front member of the first frame member and a fourth support ring affixed to the upper front member of the second frame member. A second front cable extends between and slidingly through the third and fourth support rings. A third stop block is affixed to the second front cable to the outside of the third support ring and a fourth stop block is affixed to the second front cable to the outside of fourth support ring. The front fence extends between each upper front member and is affixed to the second front cable. The third stop block is positioned along the second front cable a distance L1 from the third support ring and the fourth stop block is positioned along the second front cable a distance L2 from the fourth support ring, wherein the distance L2 is greater than the distance L1.

In one embodiment, the mounting bracket includes first and second bracket halves configured to slidingly move relative to each other to accommodate retaining walls with different thicknesses. The first and second bracket halves may have corresponding interleaving tabs adapted to reduce lateral movement of the first and second bracket halves when the first and second bracket halves move relative to each other.

In one embodiment, the mounting bracket includes a mounting plate and each lower front member has a mounting collar adapted to be removably coupled to the mounting plate. The mounting collar may be affixed to the mounting plate in different positions so as to change an orientation of the lower front member relative to the race track. In one aspect, the mounting plate has a plurality of holes and the mounting collar has a corresponding plurality of holes, where each of the holes is adapted to receive a fastener to secure the mounting collar to the mounting plate.

In another embodiment, a catch fence system includes first and second frame members spaced apart from each other, where each of the first and second frame members has a lower front member with a mounting bracket adapted to connect the lower front member to the retaining wall. The mounting bracket has first and second bracket halves configured to slidingly move with respective to each other to accommodate retaining walls with different thicknesses. A first support ring is affixed to the lower front member of the first frame member and a second support ring is affixed to the lower front member of the second frame member. A first front cable extends between and slidingly through the first and second support rings. A first stop block is affixed to the first front cable to the outside of the first support ring and a second stop block is affixed to the first front cable to the outside of second support ring. A front fence extends between each lower front member and is affixed to the first front cable. This embodiment may include one or more features of the other embodiments described above.

In yet another embodiment, a catch fence system includes first and second frame members spaced apart from each other where each of the first and second frame members has a lower front member and a rear member. The lower front member has a mounting bracket adapted to connect the lower front member to the retaining wall and the rear member is adapted to be connected to a support surface. The mounting bracket includes a mounting plate and each lower front member has a mounting collar adapted to be removably coupled to the mounting plate. A first support ring is affixed to the lower front member of the first frame member and a second support ring is affixed to the lower front member of the second frame member. A first front cable extends between and slidingly through the first and second support rings. A first stop block is affixed to the first front cable to the outside of the first support ring and a second stop block is affixed to the first front cable to the outside of second support ring. A front fence extends between each lower front member and is affixed to the first front cable. The mounting collar may be affixed to the mounting plate in different positions so as to change an orientation of the lower front member relative to the race track.

In one aspect of this embodiment, the mounting plate has a plurality of holes and the mounting collar has a corresponding plurality of holes, each of the holes adapted to receive a fastener to secure the mounting collar to the mounting plate.

In another aspect of this embodiment, the first stop block is positioned along the first front cable a distance L1 from the first support ring and the second stop block is positioned along the first front cable a distance L2 from the second support ring, wherein the distance L2 is greater than the distance L1.

This embodiment may include one or more other features of the other embodiments described above.

BRIEF DESCRIPTION OF THE DRAWINGS

The accompanying drawings, which are incorporated in and constitute a part of this specification, illustrate one or more embodiments of the invention and, together with a general description of the invention given above, and the detailed description given below, serve to explain the invention.

DETAILED DESCRIPTION OF THE INVENTION

Figure 1:
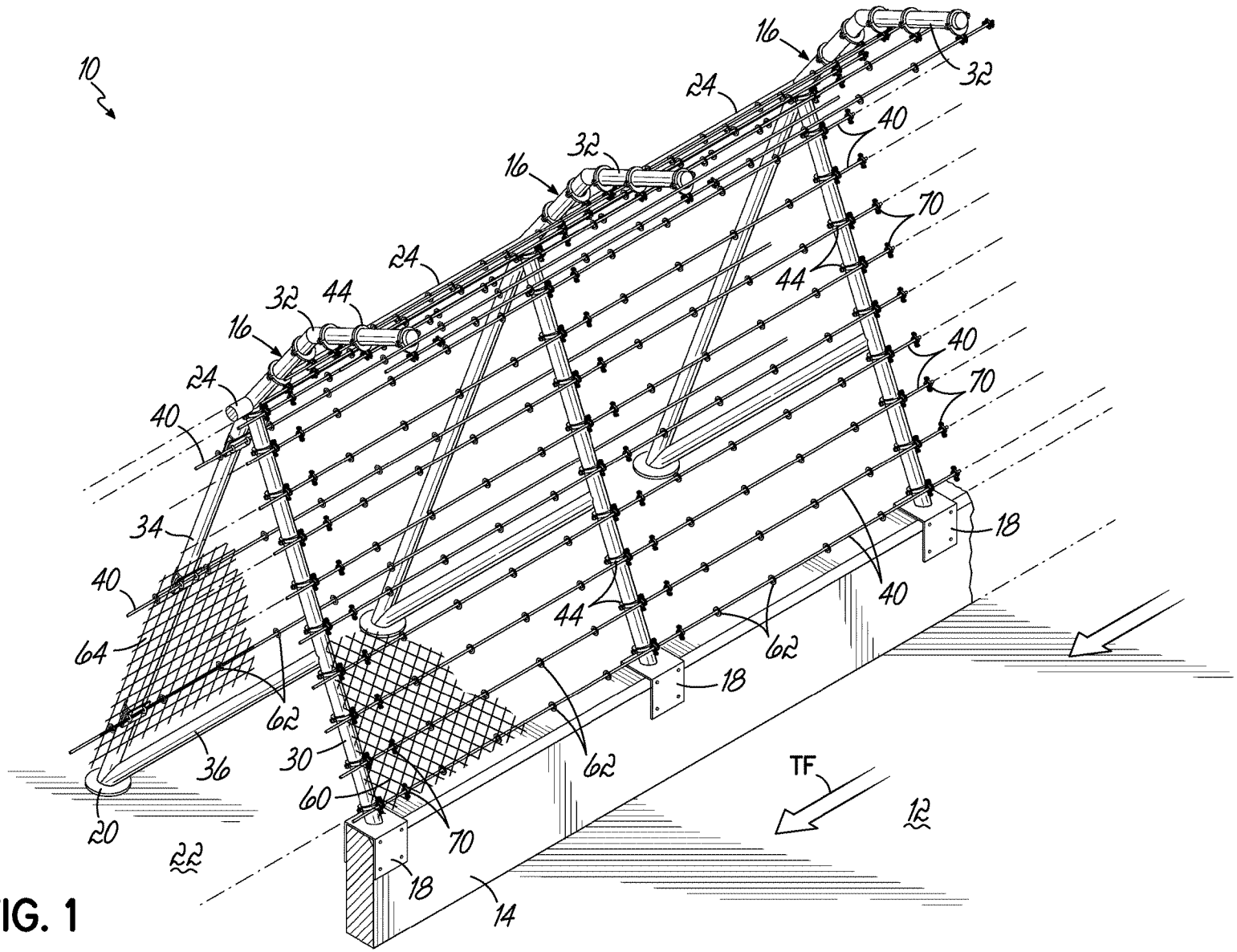
FIG. 1 is a front, perspective view of a section of a catch fence according to an embodiment of the invention.

A section of a catch fence system 10 constructed in accordance with an embodiment of the invention as illustrated in FIG. 1. The catch fence system 10 provides a safer catch fence for drivers without altering the experience of the spectators. The catch fence system may be utilized for high-speed race tracks, road courses, or temporary street course. In one exemplary setting, the catch fence system 10 may be used to encircle the entire outer boundary of a race track such that there are no breaks in the catch fence system 10. In another exemplary setting, only a portion of the catch fence system 10 may be used for protection, for example, a short section of a road course such as the type used for grand prix races through city streets. In yet another setting, the catch fence system 10 may be used on a public highway or roadway, including temporary barriers.

Unless stated otherwise, the description of the catch fence system 10 below will be based on the catch fence system 10 being installed around the entire outer boundary of a race track with no breaks in the catch fence system 10. The cars on the track will be moving in a counterclockwise direction with the traffic flow on the track being indicated by "TF" on some of the figures. In light of that traffic flow and to assist in describing the catch fence system 10, the term "front" refers to the part of the catch fence closest to the track. The term "back" or "rear" refers to the part of the catch fence system 10 further from the track. The terms "left" and "right" are taken from the perspective of someone standing on the track and looking towards the catch fence system 10.

Figure 2:
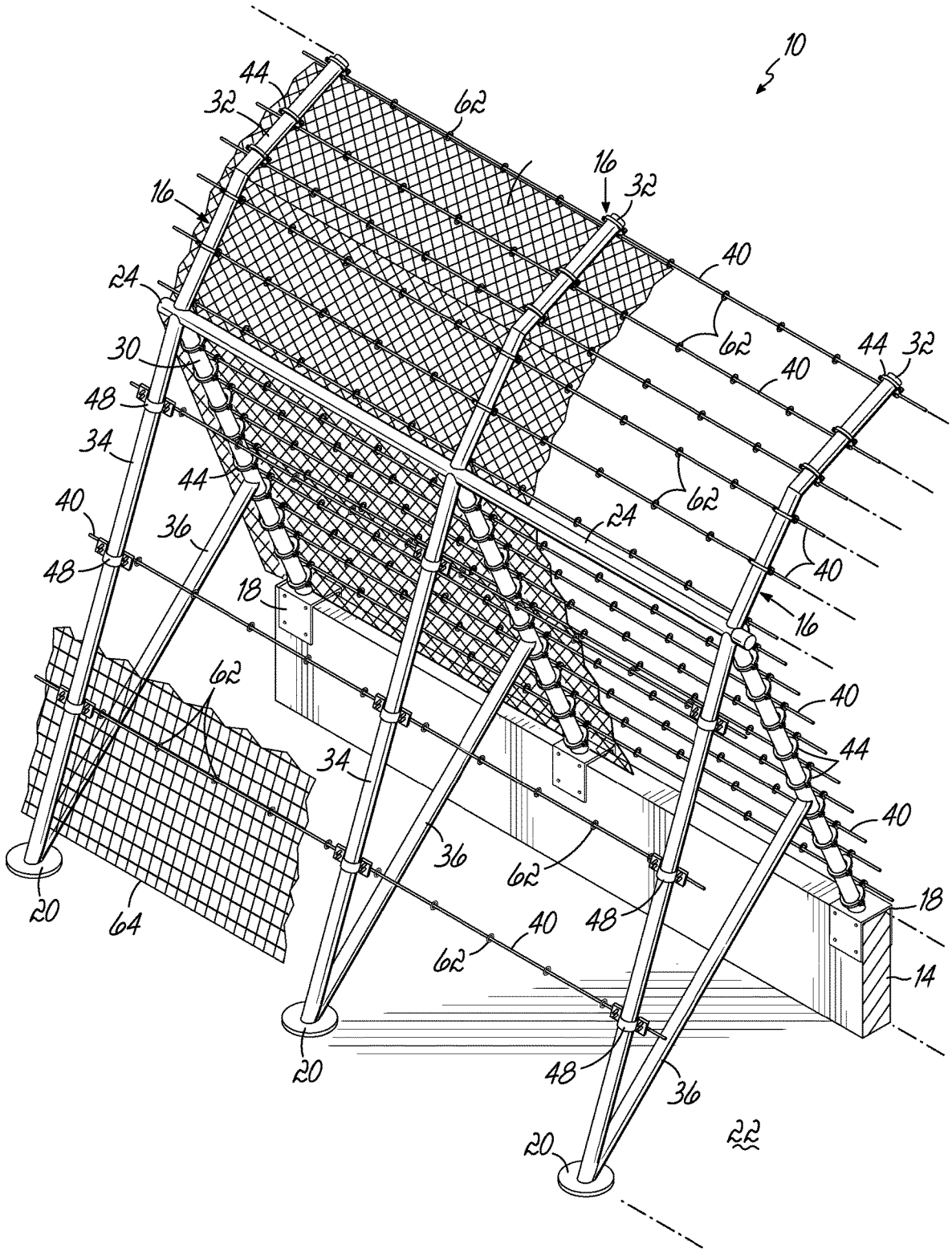
FIG. 2 is a rear, perspective view of the section of the catch fence of FIG. 1.
Figure 4:
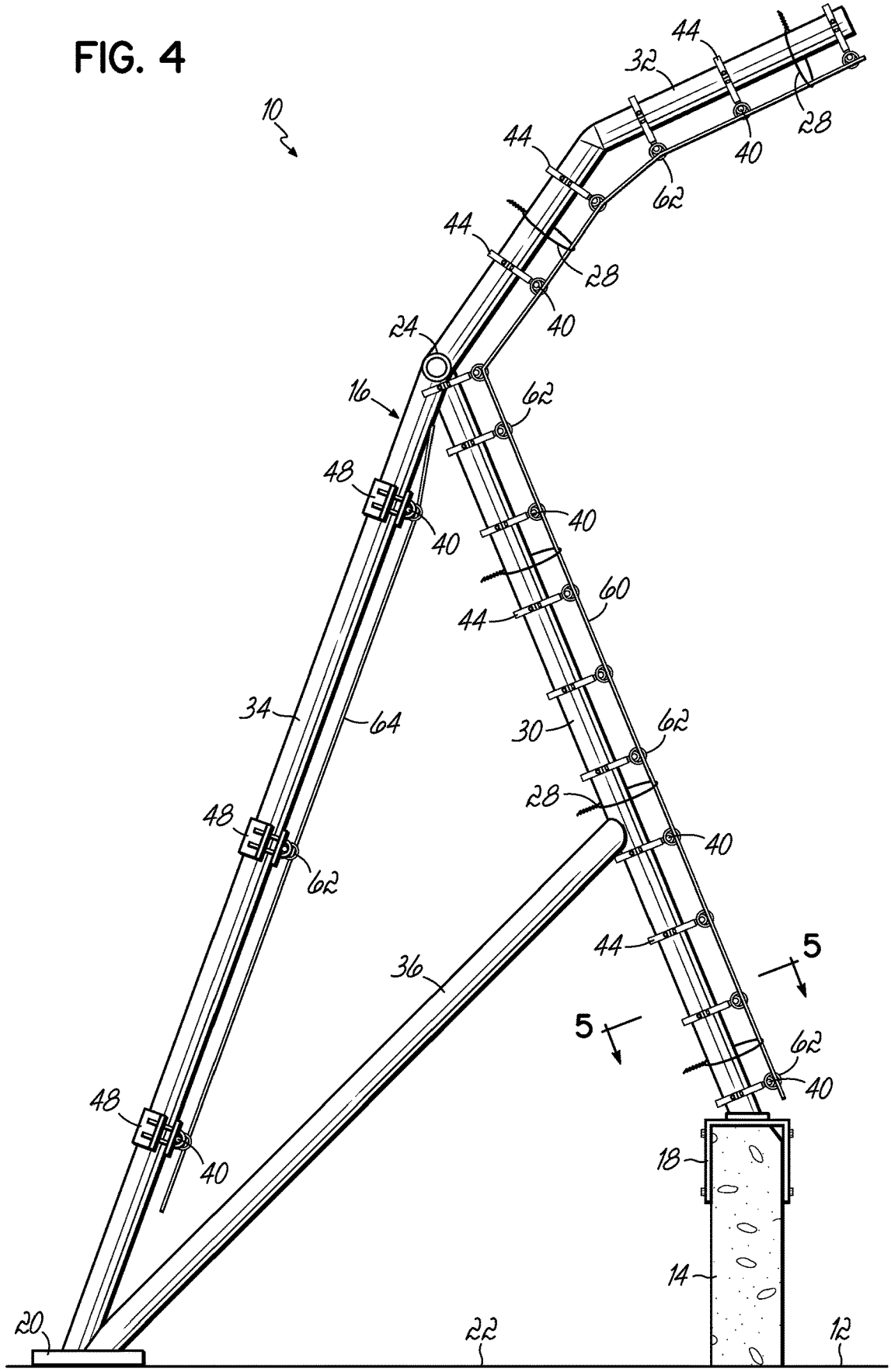
FIG. 4 is a side view of the section of the catch fence of FIG. 1.

With reference to FIG. 1, the catch fence system 10 is shown adjacent to a track 12 which includes a retaining wall 14 which extends around the entire outer perimeter of the track 12. In one embodiment the retaining wall 14 may be about 4 feet tall, but other heights may be used. As noted above, TF in FIG. 1 represents the direction of traffic flow of the cars on the track 12. The catch fence system 10 includes a plurality of spaced-apart, upright frame members 16 with wall attachment brackets 18 attaching the front of the frame members 16 to the wall 14. Each frame member 16 includes a rear foot support 20 for securing the rear of the frame member 16 to a support surface 22. Any type of suitable fastener may be used to secure the wall attachment brackets 18 to the wall 14 and the rear foot support 20 to the support surface 22. The frame members 16 may be secured laterally connected by a horizontal brace member 24 spanning between the frame members 16 as illustrated in FIG. 2. With reference to FIG. 4, each frame member 16 includes a lower front member 30, and an upper front member 32, a rear member 34, and an intermediate member 36. Each member 30, 32, 34, 36 of the frame member 16 may be made from any suitable material and have any suitable cross-section. In one embodiment, one or more of the members 30, 32, 34, 36 may be steel tubular pipes welded to one another. While each frame member 16 is illustrated substantially vertical, in one embodiment each frame member 16 may be tilted to the left, i.e., in the traffic flow direction. As will be appreciated, the rear member 34 and the intermediate member 36 help to brace the lower front member 30 and the upper front member 32 from impact forces.

Figure 4A:
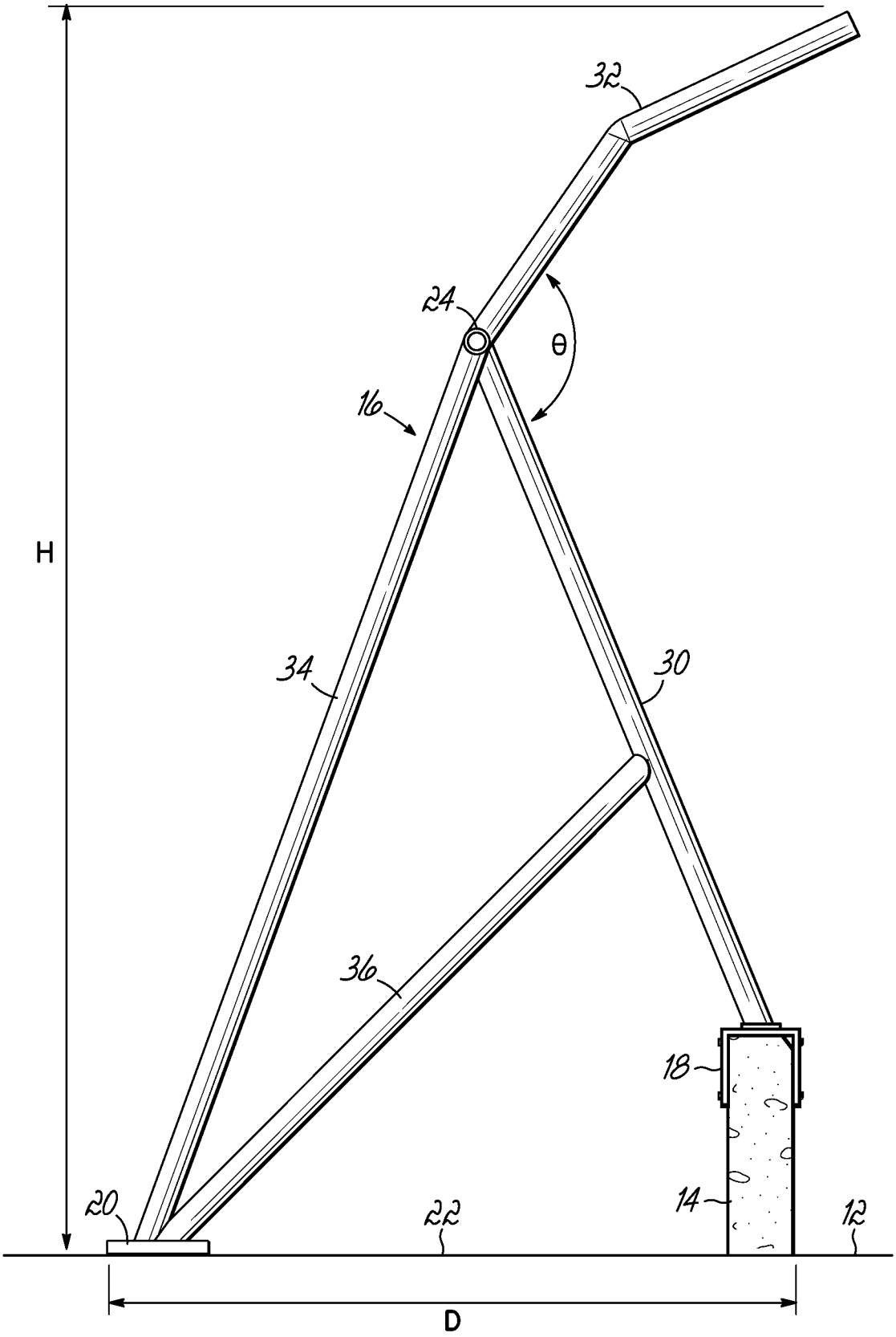
FIG. 4A is a side view showing the catch fence of FIG. 4 with certain components removed for clarity.

Although not intended to be limited to any particular dimensions for the catch fence system 10 or the frame members 16, the catch fence system 10 may have a height H as illustrated in FIG. 4A of between about 10 and 40 feet, preferably between about 15 and 30 feet, and more preferably about 20 feet. The catch fence system 10 may have depth D of between about 5 and 20 feet, and preferably between about 8 and 15 feet, and preferably about 10 feet. The lower front member 30 may have a length between 8-14 feet and preferably about 12 feet. The upper front member 32 may have a length between 6 and 12 feet and preferably about 8 feet. The rear member 34 may have a length between 10 and 20 feet and preferably about 15 feet. The intermediate member 36 may have a length between 8 and 14 feet and preferably about 11 feet. The lower front member 30 and the upper front member 32 form an angle θ of between 110 and 130 degrees and preferably about 122 degrees.

Figure 9:
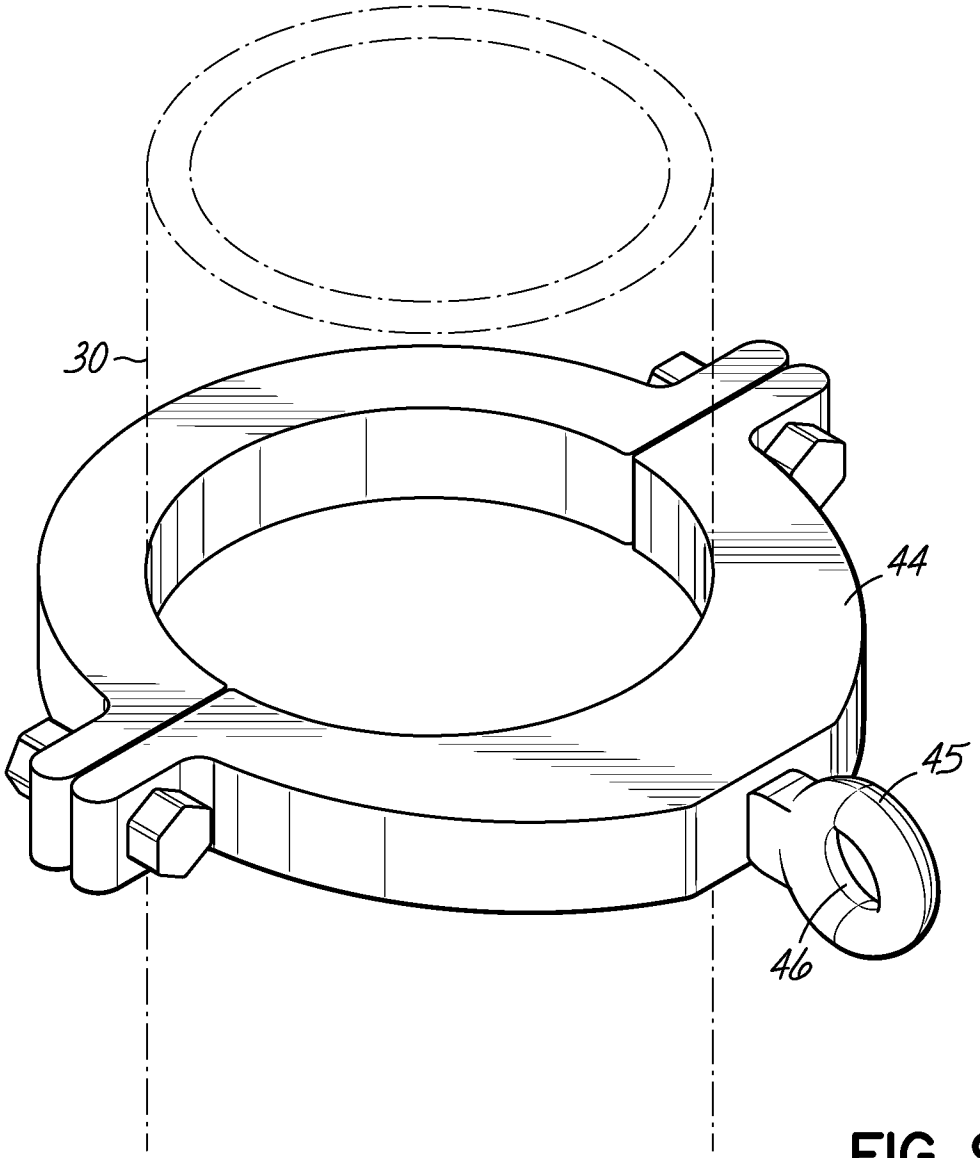
FIG. 9 is a perspective view of an eye bolt clamp.

A plurality of spaced-apart front cables 40 extend laterally between the frame members 16. The front cables 40 are located on the track (front) side of the lower frame member 30 and upper frame member 32. A plurality of spaced-apart rear cables 42 extend laterally between the frame members 16 and are located on the track side of the rear member 34. A plurality of clamps 44 with support rings 45 (FIG. 9), such as eye bolts, extending therefrom are affixed along the lower front member 30 and the upper front member 32. The front cables 40 are secured in place by running the front cables 40 through openings 46 (FIG. 9) in each eye bolt 45. The openings 46 are sized so that the front cables 40 can readily move (unobstructed) through the openings 46 and are not constricted by them. The ability of the front cables 40 to move through the openings 46 of the eye bolts 45 differs from prior designs where the cables were rigidly fixed to columns in the catch fence. The rear cables 42 are affixed along the rear members 34 with U-bolt clamps 48 as shown in FIGS. 2 and 4. The U-bolt clamps 48 secure the rear cables 42 to the rear members 34 so that the rear cables 42 cannot readily move relative to U-bolt clamps 48 and the rear members 34. With reference to FIG. 4, the clamps 44 may be spaced along the lower front member 30 between about 0.5 to 3 feet apart and preferably about 1 foot.

Figure 1A:
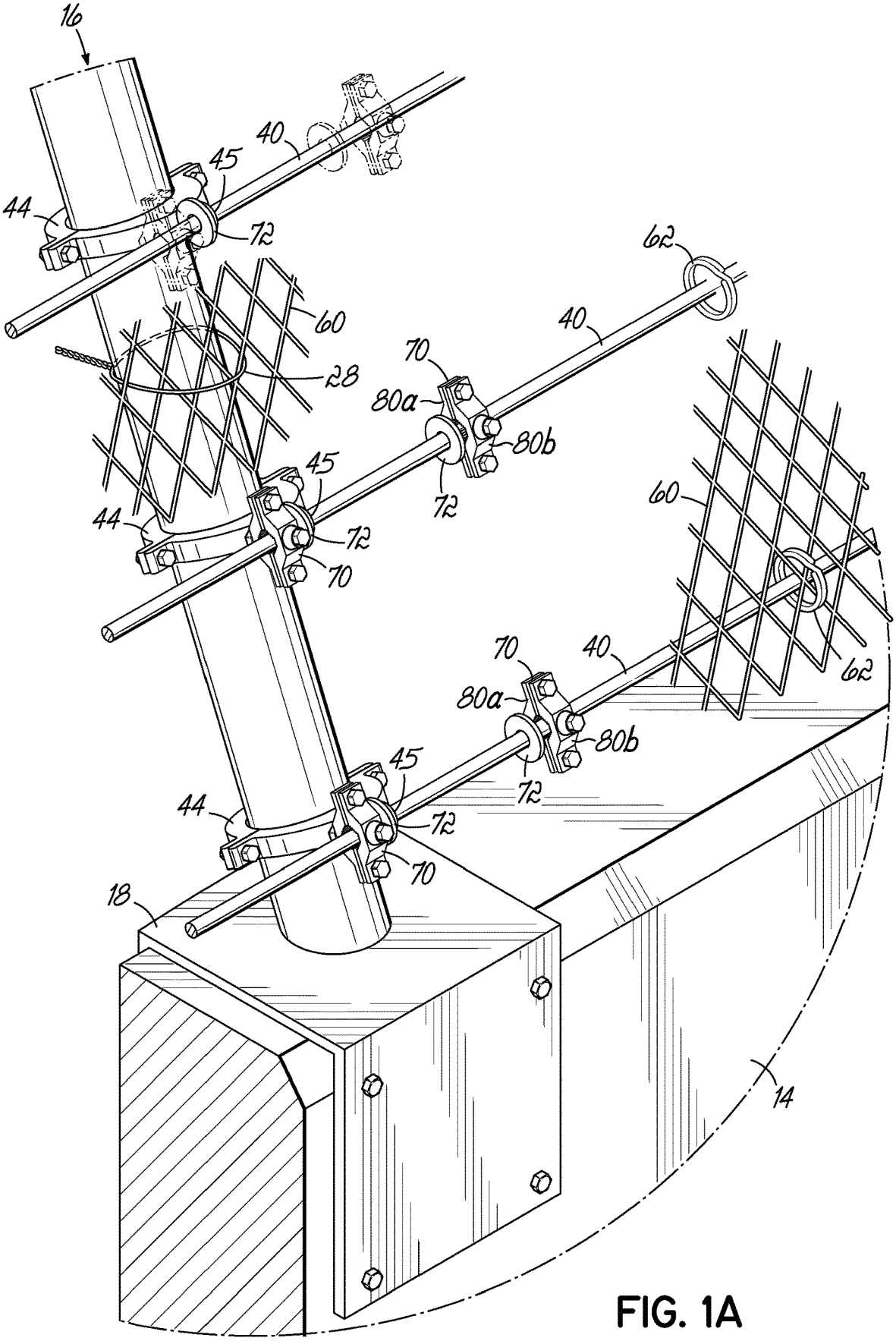
FIG. 1A is an enlarged portion of the catch fence of FIG. 1.

A front fence 60 is attached to the track side of the front cables 40 via a ring connector 62 as illustrated in FIG. 1A. The front fence 60 may be any fence suited to resist the force of a car impacting the catch fence system 10. In one embodiment, the front fence 60 may be a 2" by 2" chain link fence made of steel. A rear fence 64 may be attached to the track side of the rear cables 42 via the ring connectors 62. The ring connectors 62 are sized to loop around the front fence 60 and the front cables 40 such that the front cables 40 may slide unimpeded through the ring connectors 62. Preferably, the ring connector is configured to not gouge, snag, or pocket the front cable 40 as the front cable 40 slides through ring connector 62. The rear fence 64 may be any suitable fence suited to stop large pieces of debris from hitting spectators watching the race. In one embodiment, the rear fence 64 may be a 4" by 4" braided fence. In one embodiment, additional fence ties 66 may be used to further secure the front fence 60 to the lower and upper front members 30, 32.

Figure 7:
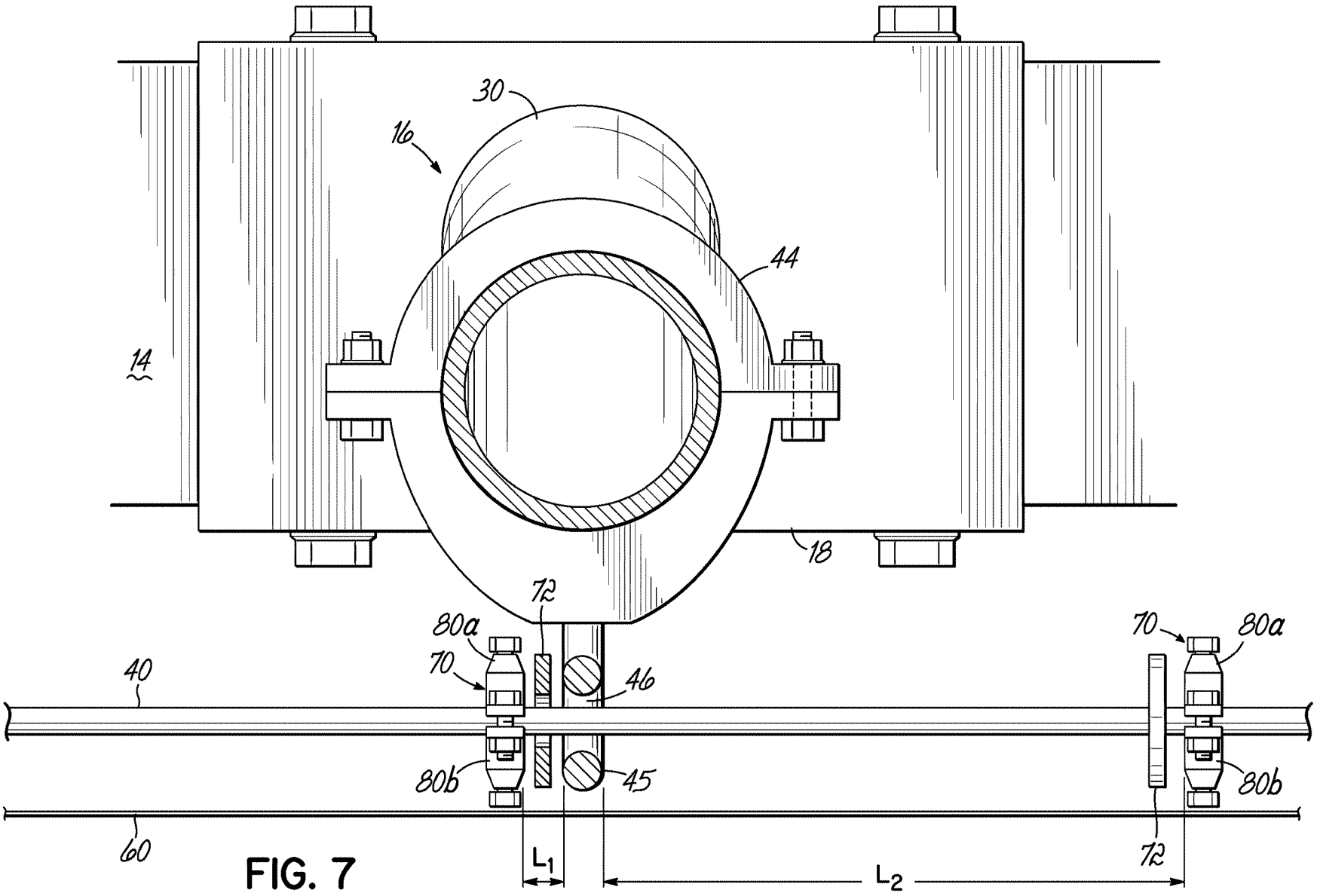
FIG. 7 is an enlarged cross-sectional view of the catch fence showing the stop blocks in their undeflected positions.
Figure 8:
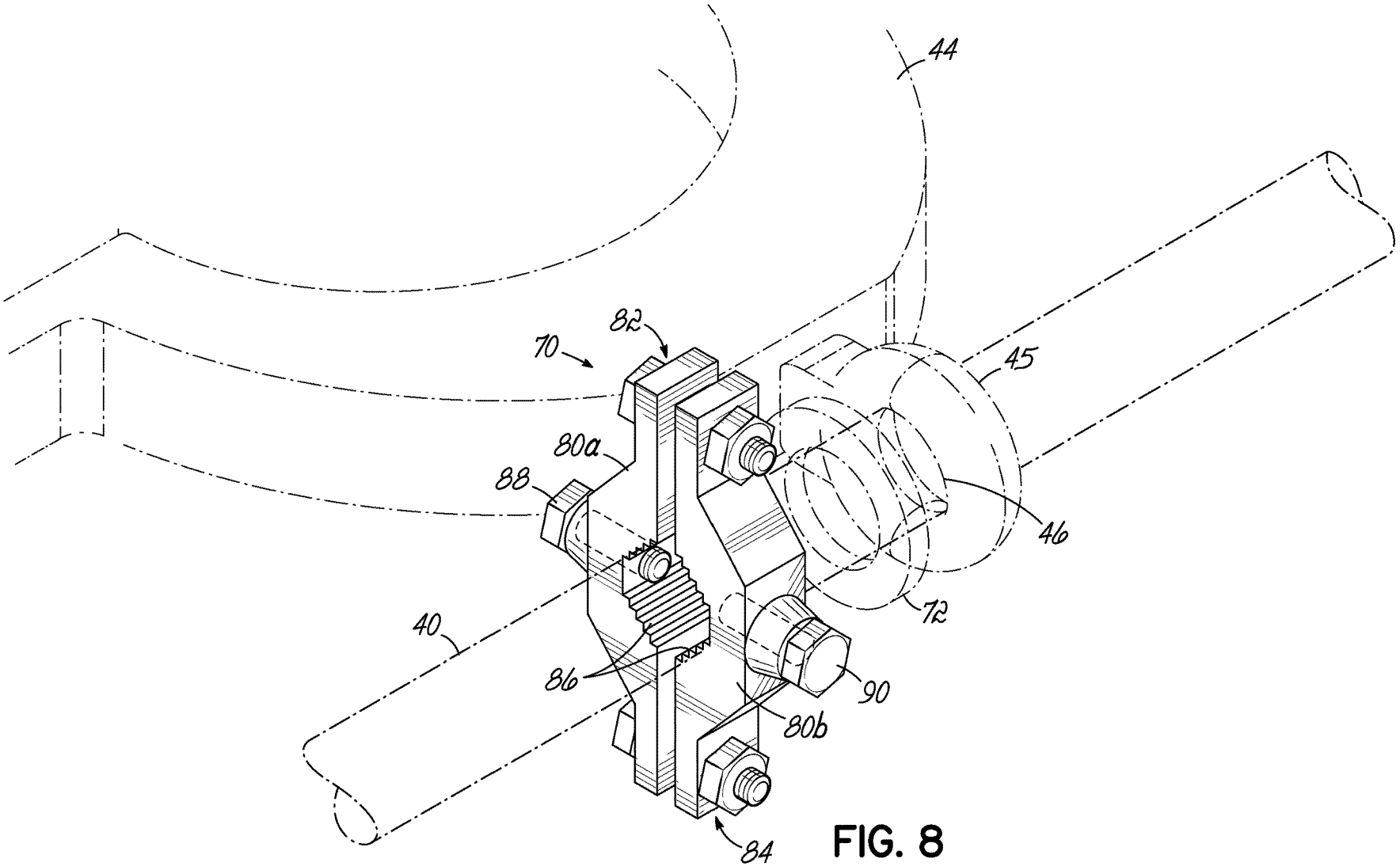
FIG. 8 is a perspective view of a stop block.

The catch fence system 10 also includes stop blocks 70 attached to the front cables 40 as illustrated in FIG. 1A. In one embodiment, one stop block 70 is attached to the front cable 40 near the left side of each eye bolt 45 and another stop block 70 is attached to the front cable 40 on the right side of the eye bolt 45. The stop blocks 70 near the left side of each eye bolt 45 is spaced a distance L1 (FIG. 7) from each eye bolt 45. The stop blocks 70 on the right side of each eye bolt 45 is spaced a distance L2 (FIG. 7) from each eye bolt. Preferably, the distance L2 is greater than the distance L1. In one embodiment, the distance L2 is approximately 12 inches. It should be appreciated that the particular spacing of the stop blocks 70 is based on the direction of the traffic flow TF as designated in the figures (e.g., FIGS. 1 and 5). Thus, if the direction of the traffic flow TF was reversed, the spacing of the stop blocks 70 relative to the eye bolts 45 would mirror the current spacing shown in FIG. 7. A washer 72 is positioned on the front cable 40 between the stop blocks 70 and the eye bolt 45. As illustrated in FIG. 8, each stop block 70 is designed to robustly grip the front cable 40 so the stop block 70 will not move relative to the front cable 40 when a car impacts the catch fence system 10. The arrangement of the stop blocks 70 strengthens the catch fence system 10 because every stop block 70 associated with each eye bolt 45 will collectively provide support to the impacted section of the front cables 40 between two frame members 16. Under a wide variety of impacts, the front cables 40 will return to the normal position they were in prior to the car impacting them.

Various aspects of the catch fence system 10 may be customized to account for the type of racing and cars (or vehicles) being used on the track 12 For example, the spacing of the stop blocks 70 on either side of the eye bolt 45 may be changed. In addition, the spacing of the clamps 44 along the lower frame member 30 may also be altered to account for different race and car scenarios. The lateral spacing between frame members 16 may be altered or additional frame members 16 may be added. The thickness (diameter) of the front cables 40 may be customized as well. For instance, the upper-most front cables 40, i.e., those further from the track 12, may be a smaller thickness (diameter) so they can flex more. The angles between the various members 30, 32, 34, 36 may be altered as well as the circumstances warrant. As mentioned above, should the traffic flow TF reverse direction, the stop blocks 70 would need to be repositioned relative to the eye bolts 45.

One exemplary stop block 70 is illustrated in FIG. 8. In this example, the stop block 70 has first and second halves 80*a*, 80*b* that are clamped together by fasteners 82, 84. Each of the halves 80*a*, 80*b* includes grooves 86 extending in a direction parallel to the front cable 40. When the fastener 82, 84 clamp the two halves 80*a*, 80*b* together, the grooves 86 will positively engage the front cable 40 so the stop block 70 will not move relative to the front cable 40. Additional fasteners 88, 90 may be threaded into each of the respective first and second halves 80*a*, 80*b* and also engage the front cable 40 much like the grooves 86 do to ensure that the stop block 70 does not move relative to the front cable 40.

Figure 5:
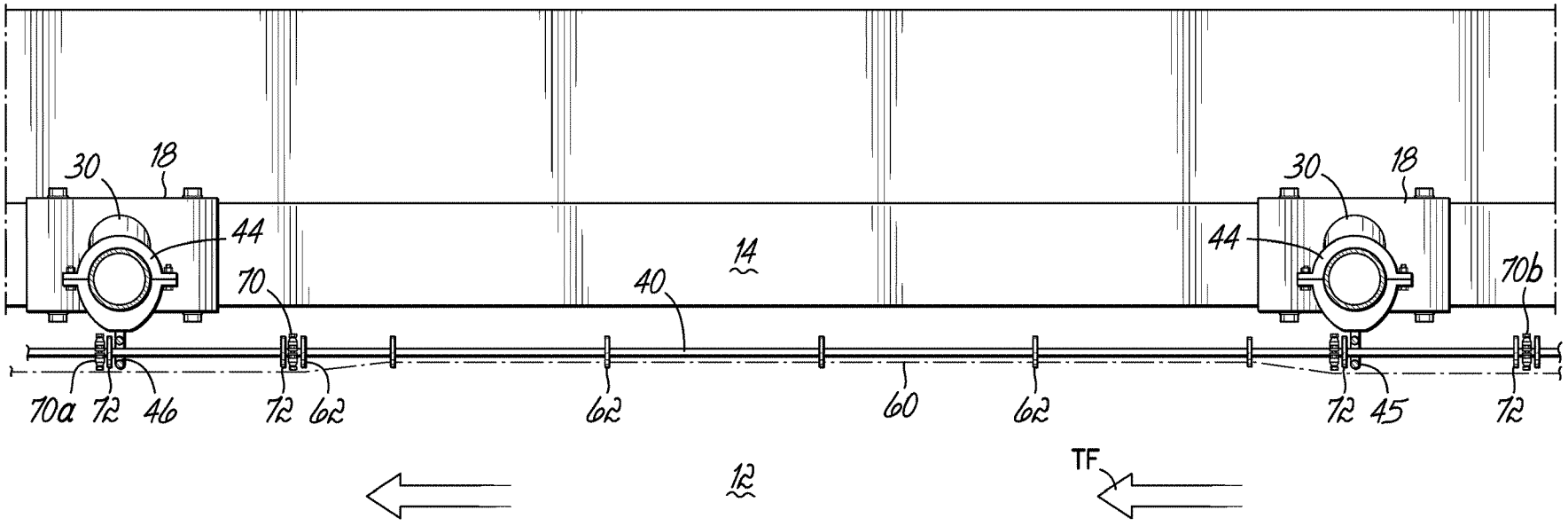
FIG. 5 is a cross-sectional view of the catch fence of FIG. 4 taken along line 5-5.
Figure 6A:
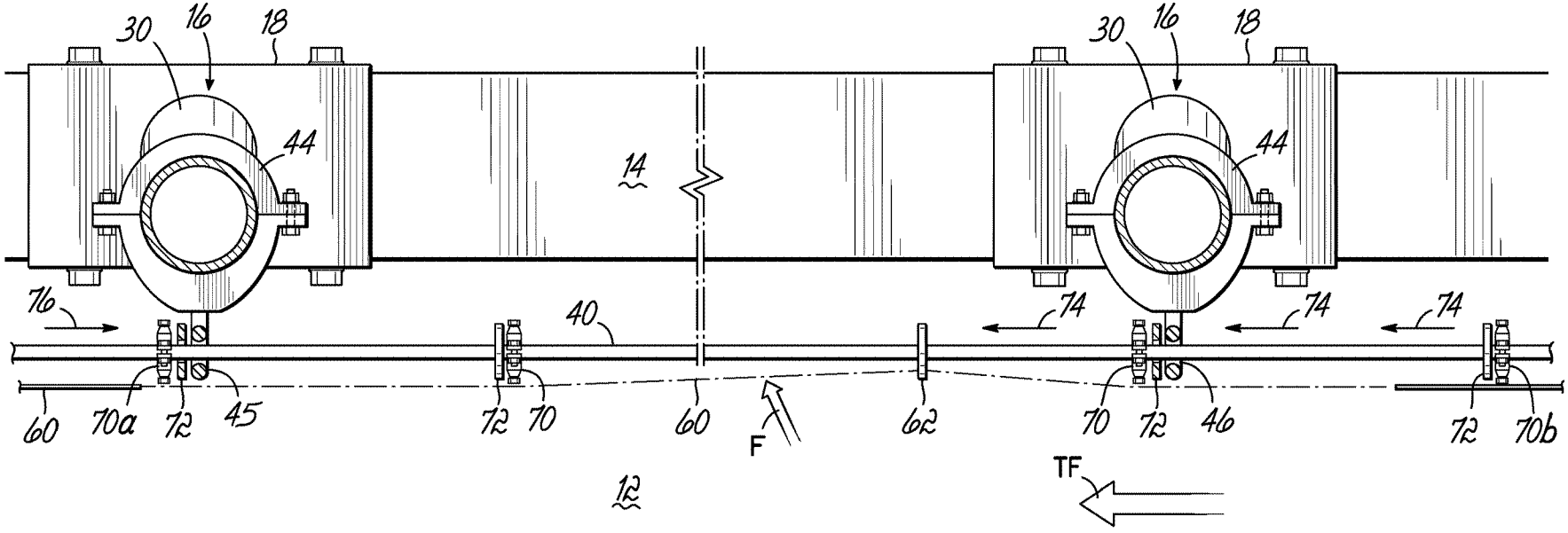
FIG. 6A is an enlarged view of FIG. 5 showing the initial impact on the catch fence by a force.

FIG. 5 illustrates the catch fence system 10 in an exemplary embodiment with no external force (such as a car)

impinging on the catch fence system 10. One may consider the catch fence system 10 to be in its "normal, unimpacted" position. FIG. 6A schematically illustrates the catch fence system 10 just as a force F begins to impinge upon the catch fence system 10. The force F may represent a car leaving the track 12 and striking the catch fence system 10. In one common impact, the car will strike the catch fence system 10 such that the force F will have a component in the traffic flow TF direction and a component perpendicular to the traffic flow TF towards the rear of the catch fence system 10. As the force F begins to impinge upon the front fence 60 and the front cables 40, the section of the front cable 40 between two opposing frame members 16 starts to move towards the rear of the catch fence system 10. When this occurs, the section of the front cable 40 to the right of the force F begins to move from right to left as shown by the arrows 74 in FIG. 6A. Similarly, the section of the front cable 40 to the left of the force F begins to move from left to right as shown by the arrow 76 in FIG. 6A.

Figure 6B:
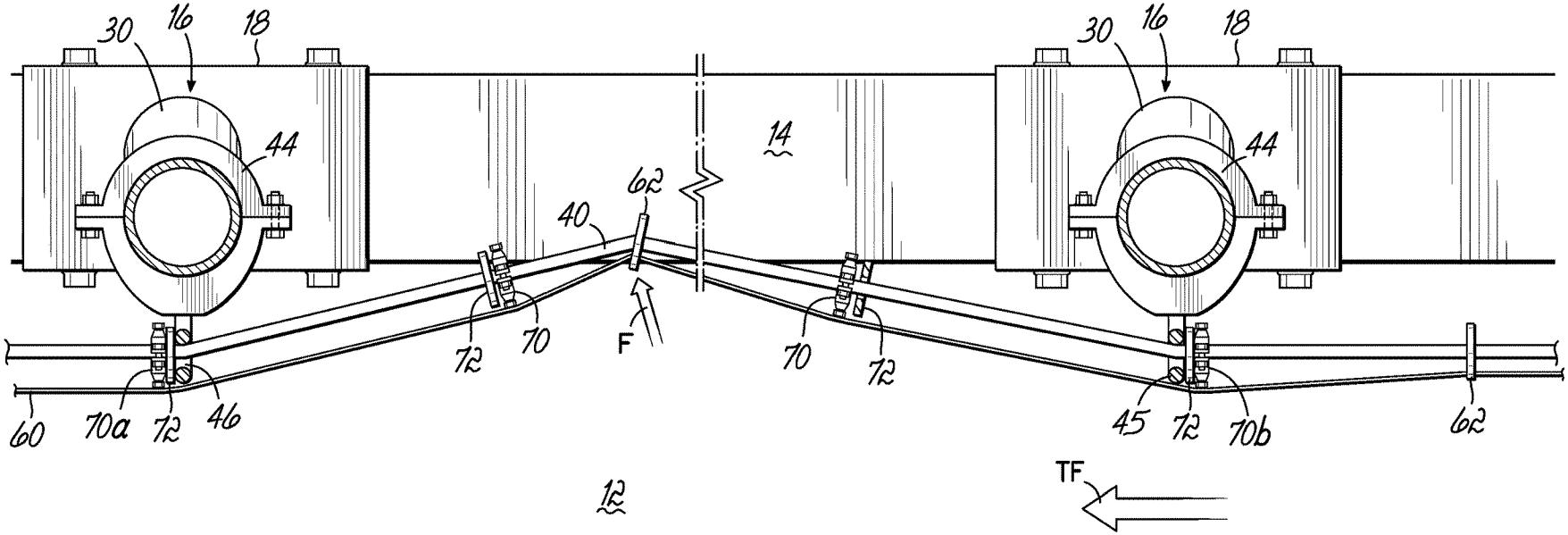
FIG. 6B is similar view of FIG. 6A showing deflection of portions of the catch fence caused by a force.

As the force F continues to be applied, i.e., the car moves further into the catch fence system 10, the front fence 60 and the front cables 40 further deflect away from the track 12 towards the rear of the catch fence system 10. At a certain deflection, one or more of the stop blocks 70 will reach their maximum travel where they will contact and be stopped by the eye bolt 45 as illustrated in FIG. 6B. As one stop block 70 reaches the eye bolt 45, the stop block 70 compresses the washer 72 between the stop block 70 and the eye bolt 45. Because a stop block 70*a* to the left (i.e., outside of the left eye bolt 45 in FIG. 7) of the force F and on the other side of the eye bolt 45 is positioned close to the eye bolt 45, that stop block 70*a* will contact that eye bolt 45 before a stop block 70*b* to the right (i.e., outside of the right eye bolt 45 in FIG. 7) of the force F and on the other side of the other eye bolt 45. This configuration allows the front cables 40 to cushion and redirect the car as it contacts the front fence 60 and the front cables 40. The stop blocks 70 extend the slack to every frame member 16 positioned to the right of, i.e., behind, the crash, allowing the majority of the catch fence system 10 to absorb the energy of the impact. The two stop blocks 70 positioned between the two adjacent frame members 16 move with the front cables 40, but otherwise do not play a role during the impact.

As the car elevates off the track 12, it will encounter the next front cable 40, which will push it back to slow the car's ascent until the car can no longer push back the upper most front cables 40, thus, ending the ascent. Thus, the catch fence system 10 provides for vertical pocketing of a crashing car. The stop blocks 70 on the higher front cables 40 may be adjusted, as well as their size and flexibility to achieve that vertical pocketing. The angle of the car's impact will be a main factor determining the number of vertical sections of the catch fence system 10 that are involved. Impacts near the apex of the turn will likely engage the higher sections of the catch fence system 10. By changing the angles, lengths, and spacing between the lower front members 30 and upper front members 32, the catch fence system 10 may be adapted for use on any section of the course.

Each front cable 40 is able to move independently of the other front cables 40. However, because all the front cables 40 are connected to the front fence 60, any deflection of one front cable 40 may cause one or more front cable 40 to also deflect.

Figure 10:
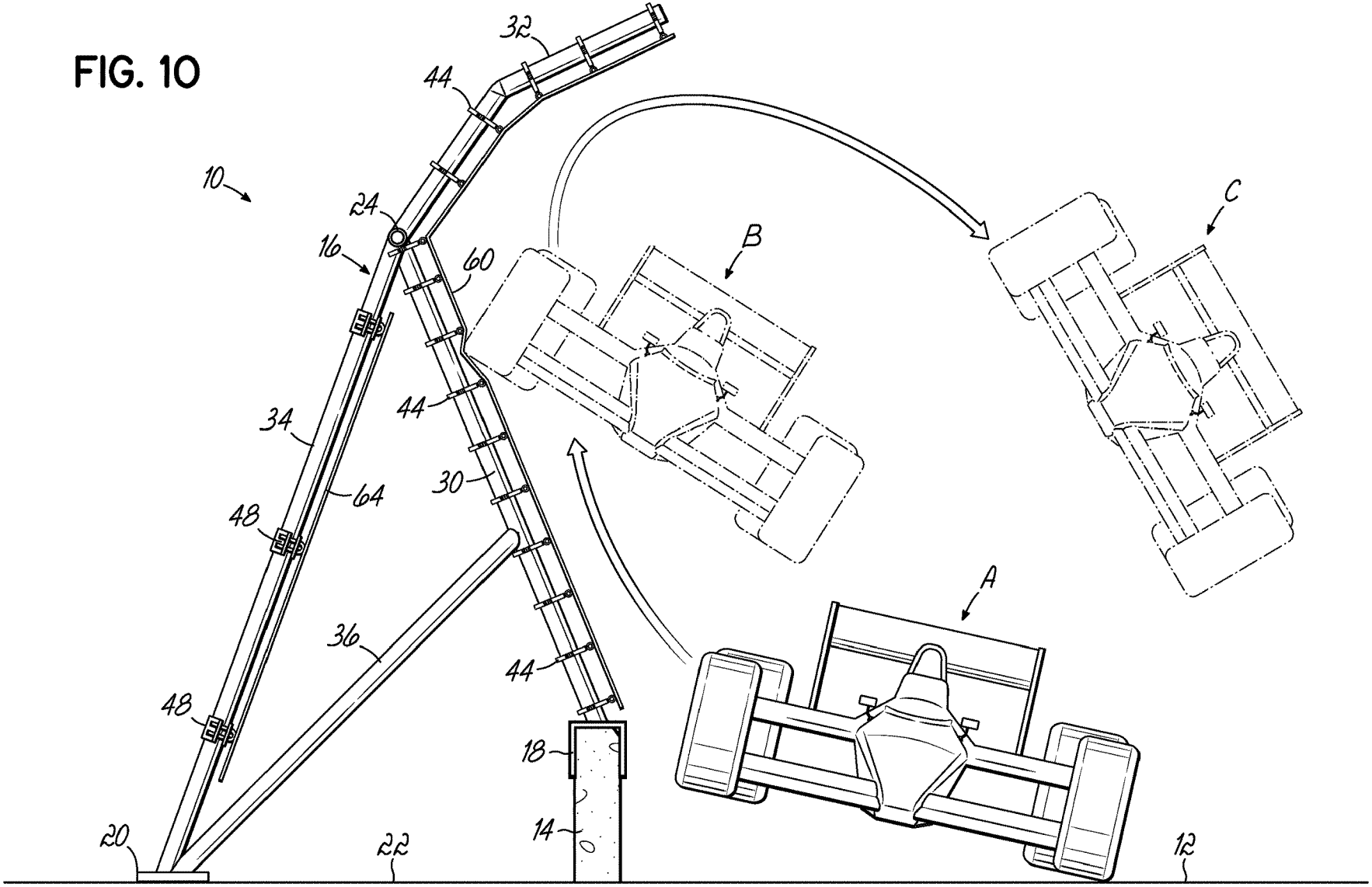
FIG. 10 is a side view of the catch fence of FIG. 1 schematically illustrating a car leaving the track surface, impacting the fence, and moving back towards the track.

As shown in FIGS. 4 and 10, the lower front member 30 tilts rearwardly, away from the track 12, whereas the upper front member 32 tilts forwardly towards the track 12. The rearward tilt of lower front member 30 helps to mitigate the initial impact of the car onto the catch fence system 10. The forward tilt of the upper front member 32 helps deflect a car that has contacted the catch fence system 10 back towards track 12 keeping the car from entering the stands filled with spectators. FIG. 10 illustrates a schematic sequence of a car 100 in position A starting to lift off the track 12, which may occur when the car 100 is contacted by another car (not shown) or if the car 100 loses control while racing on the track 12. In position B, the car 100 has moved upwardly and has contacted the front fence 60 which will likely cause one or more of the front cables 40 to deflect and some of the stop blocks 70 may impact the eye bolt 45 (sandwiching the washer 72 in between). Should the car 100 travel upwardly enough, it may contact the front fence 60 positioned along the upper front members 32. Because the upper front members are tilted toward the track 12, the car 100 will likely be deflected back towards track 12 as shown by position C in FIG. 10. FIG. 10 schematically represents one of many possible scenarios by which the car 100 may interact with the catch fence system 10. One primary goal of the catch fence system 10 is to protect not only a driver in a car contacting the catch fence system 10 because of a crash, but also to protect spectators positioned behind the catch fence system 10, such as in the stands, from being struck by debris from the crashing car.

FIGS. 12A-13B illustrates two features that provide for adjustability depending upon the installation requirements of the catch fence system 10. For example, the thickness of the retaining wall 14 may vary from race track to race track. To accommodate the varying thickness, the wall attachment bracket 18 may have two bracket halves 130*a*, 130*b* that may slidingly move towards and away from, i.e., relative to, each other to change the distance between sidewalls 132*a*, 132*b*. The two bracket halves 130*a*, 130*b* may have interleaving tabs 134 that keep the two bracket halves 130*a*, 130*b* aligned and reduces lateral movement, i.e., in the traffic flow TF direction, of the two brackets halves 130*a*, 130*b* when the two bracket halves 130*a*, 130*b* move relative to each other. The two bracket halves 130*a*, 130*b* also have slots 136 to accommodate the adjustability of the two bracket halves 130*a*, 130*b*. The two bracket halves 130*a*, 130*b* are secured to the sides of the retaining wall 14 via fasteners 138, such as lag bolts, inserted directly into the retaining wall 14. Other suitable fastening arrangements may also be used. A base member 139 with a mounting plate 140 may be secured to the two bracket halves 130*a*, 130*b*, via fasteners 142 passing through slots 136 and inserted directly into the top of the retaining wall 14. The mounting plate 140 includes a plurality of threaded holes 144. As illustrated in the FIG. 12A, adjacent threaded holes 144 are separated by approximately 22.5 degrees.

Figure 12A:
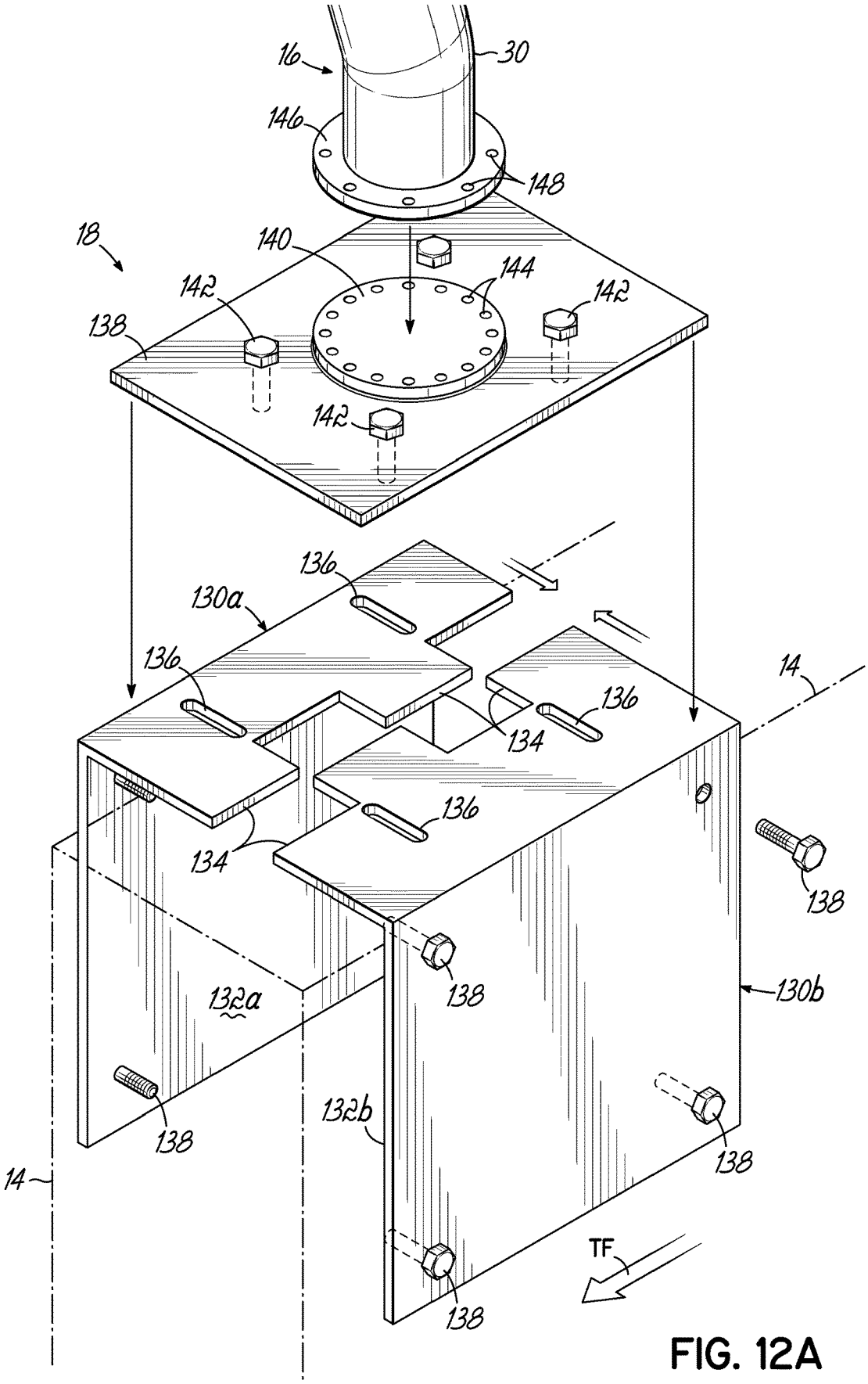
FIG. 12A is a disassembled perspective view of a mounting bracket and a mounting plate at the end of a lower front member.
Figure 12B:
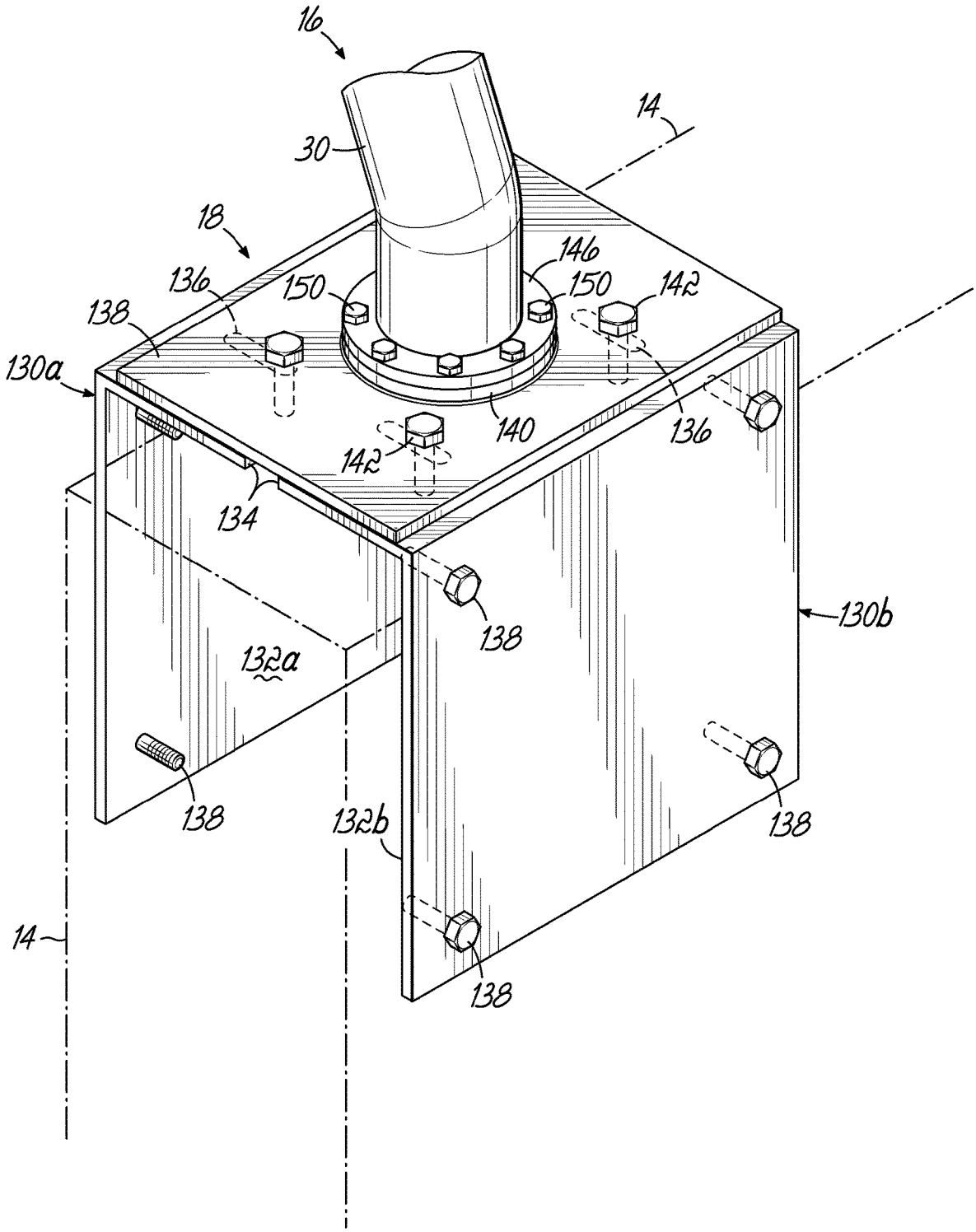
FIG. 12B is a perspective view of the mounting plate secured to the mounting plate.
Figure 13B:
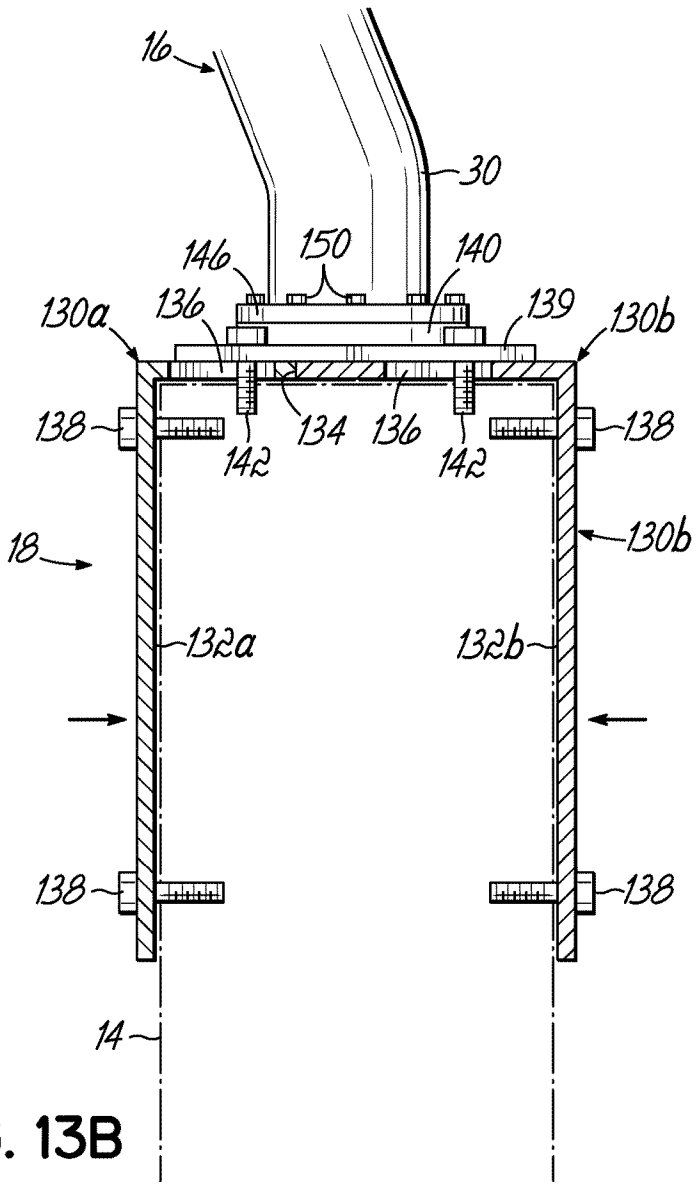
FIG. 13B is a cross-sectional view of the mounting bracket affixed to a thinner retaining wall.
Figure 13A:
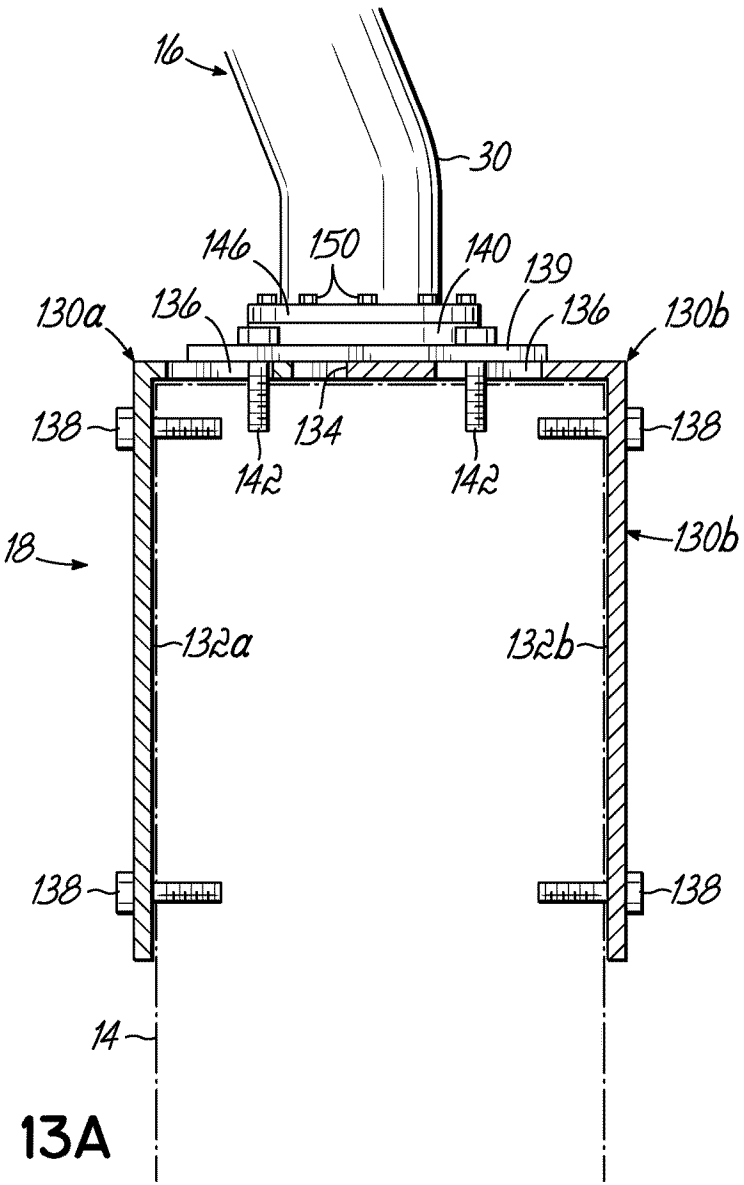
FIG. 13A is a cross-sectional view of the mounting bracket affixed to a thick retaining wall.

The lower end of the lower front member 30 may include a mounting collar 146 which may have plurality of throughholes. 148. When assembled as shown in FIG. 12B, the mounting collar 146 rests upon the mounting plate 140 with the throughholes 148 aligned with at least some of the threaded holes 144 and fasteners 150 securing the mounting collar 146 to the mounting plate 140.

Figure 3:
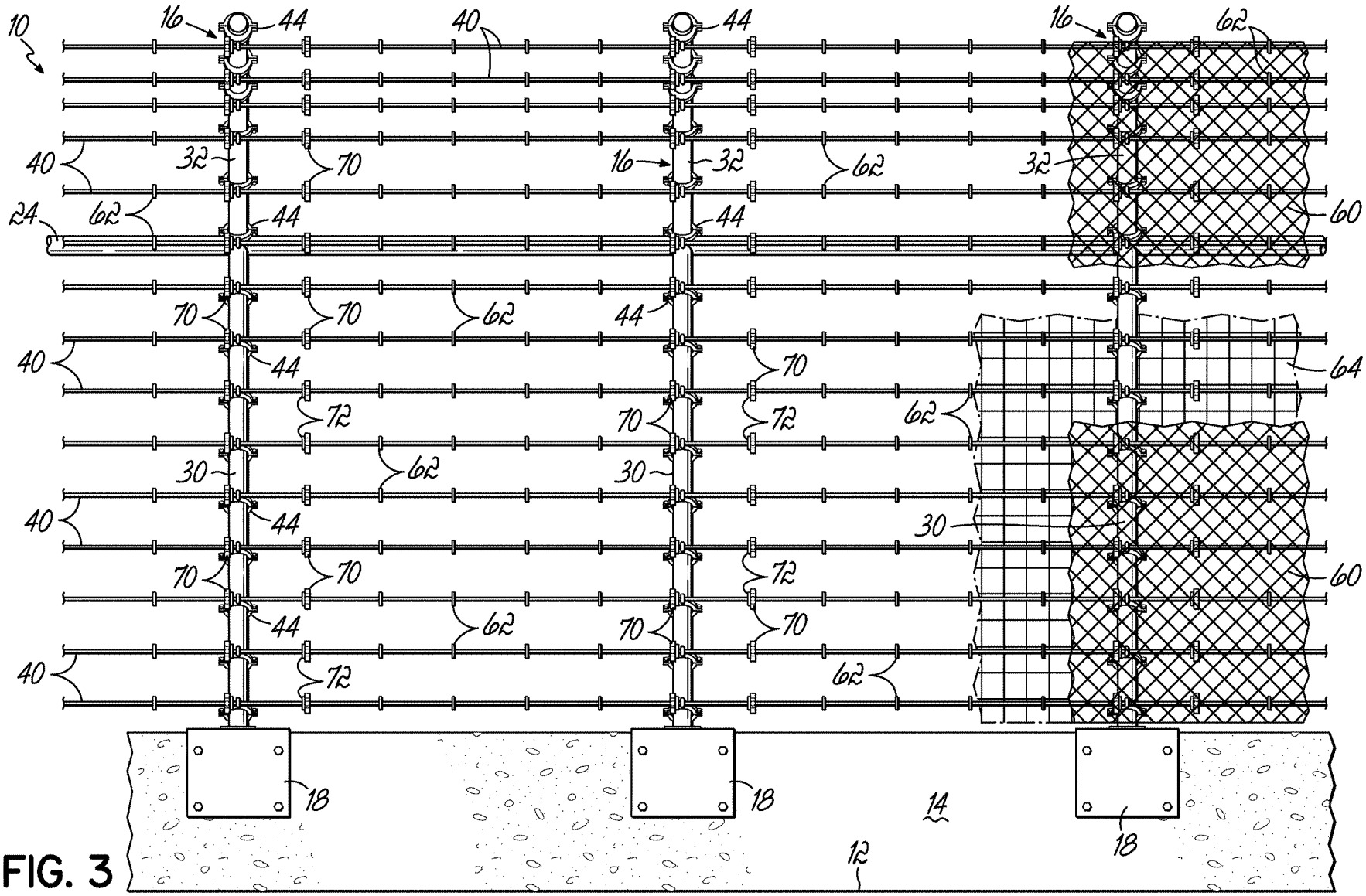
FIG. 3 is a front elevational view of the section of the catch fence of FIG. 1.

As discussed above, the lower front member 30 may be tilted rearwardly away from the track 12. The orientation of the lower front member 30 relative the traffic flow TF may be altered by rotating the lower front member 30 and thus the mounting collar 146 relative to the mounting plate 140. For example, as illustrated in FIG. 3, the longitudinal axis of the lower front member 30, while tilted back, is essentially perpendicular to the traffic flow TF. In some racing circumstances, it may be preferable to change the orientation of the longitudinal axis of the lower front member 30 such that it not only tilts rearwardly, but also in the direction of the traffic flow TF. To achieve this particular orientation, the lower front member 30 and the mounting collar 146 (with the current orientation illustrated in FIG. 3) may be rotated counterclockwise (as seen from above in FIG. 12A) by 22.5 degrees, for example, and then secured to the mounting plate 140. With lower front member 30 both tilted away from the track 12 and with the longitudinal axis of the lower front member 30 angled in the direction of traffic flow TF, a crashing car will experience less resistance and therefore a reduced impact force when it strikes one of the lower front members 30.

Figure 11:
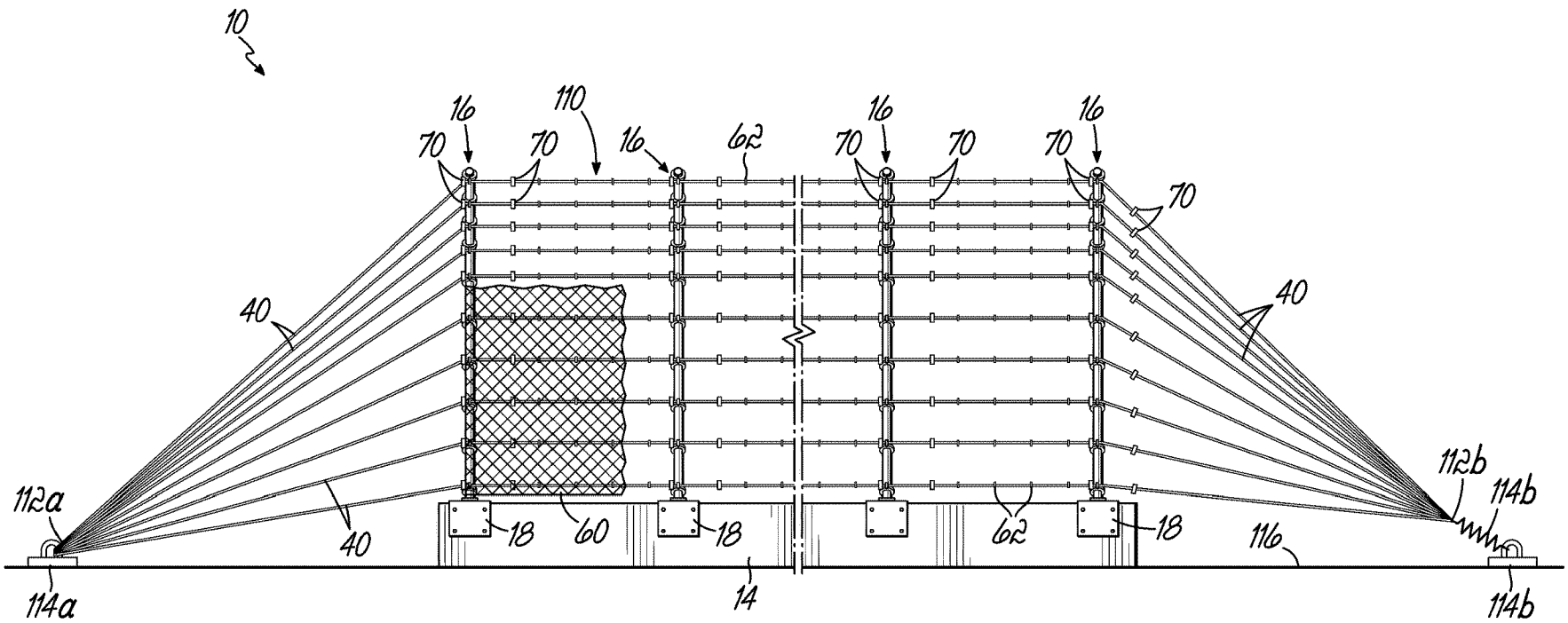
FIG. 11 is a front elevational view of an alternative embodiment of the catch fence shown with terminating sections on both ends.

The description of the catch fence system 10 above assumed that the catch fence system 10 was installed around the entire outer boundary of a race track with no breaks in the catch fence system 10. In another embodiment, the catch fence system 10 may be only a segment, which does not go around the entire outer boundary of a race track or is used along, for example. In such a situation the terminating ends of the front cables 40 would have to be secured. FIG. 11 schematically illustrates a segment 110 of the catch fence system 10 with frame members 16 at opposing ends of the segment 110. Because the catch fence system 10 does not wrap around an entire race track, the ends of the front cables 40 must be anchored so the front cables 40 and the stop blocks 70 may function as discussed above when a car impacts the catch fence system 10. To that end, terminal ends 112*a*, 112*b* of the front cables 40 are secured to anchors 114*a*, 114*b*, which are themselves secured to a support surface 116. In one embodiment, a resilient member, such as a spring 118, maybe positioned between the terminated end 112*b* and anchor 114*b*. The spring 118 allows the front cables 40 to deflect a little further as a car impacts the catch fence system 10 to help further dissipate some of the crash energy. Despite the catch fence system 10 being only a segment 110, the catch fence system 10 nevertheless has all the components and functionality as the catch fence system 10 illustrated in FIGS. 1-10 and described above.

While the invention has been illustrated by a description of various embodiments, and while these embodiments have been described in considerable detail, it is not the intention of the Applicant to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the spirit or scope of the Applicant's general inventive concept.

What is claimed is:

1. A catch fence system for use at a race track having a retaining wall bordering at least a portion of the race track, comprising:

first and second frame members spaced apart from each other, each of the first and second frame members has a lower front member and a rear member, the lower front member having a mounting bracket adapted to connect the lower front member to the retaining wall, the rear member adapted to be connected to a support surface;

first and second support rings, the first support ring being affixed to the lower front member of the first frame member, and the second support ring being affixed to the lower front member of the second frame member;

a first front cable extending between and slidingly through the first and second support rings;

first and second stop blocks, the first stop block affixed to the first front cable to the outside of the first support ring, and the second stop block affixed to the first front cable to the outside of the second support ring; and a front fence extending between each lower front member and affixed to the first front cable;

wherein the first stop block is positioned along the first front cable a distance L1 from the first support ring and the second stop block is positioned along the first front cable a distance L2 from the second support ring, wherein the distance L2 is greater than the distance L1.

2. The catch fence system of claim 1 further comprising:

a rear cable extending between and affixed to the rear member of the first and second frame members; and a rear fence extending between the first and second frame members and affixed to the rear cable.

3. The catch fence system of claim 1, wherein the lower front member of each of the first and second frame members is tilted rearwardly away from the race track.

4. The catch fence system of claim 3, wherein each of the first and second frame members has an upper front member tilting forwardly towards the race track.

5. The catch fence system of claim 1, wherein each of the first and second frame members has an upper front member, the catch fence system further comprising:

third and fourth support rings, the third support ring being affixed to the upper front member of the first frame member, and the fourth support ring being affixed to the upper front member of the second frame member;

a second front cable extending between and slidingly through the third and fourth support rings; and third and fourth stop blocks, the third stop block affixed to the second front cable to the outside of the third support ring, and the fourth stop block affixed to the second front cable to the outside of the fourth support ring;

wherein the front fence extends between each upper front member and is affixed to the second front cable; and wherein the third stop block is positioned along the second front cable a distance L1 from the third support ring and the fourth stop block is positioned along the second front cable a distance L2 from the fourth support ring, wherein the distance L2 is greater than the distance L1.

6. The catch fence system of claim 1, wherein the mounting bracket includes first and second bracket halves configured to slidingly move relative to each other to accommodate retaining walls with different thicknesses.

7. The catch fence system of claim 6, wherein the first and second bracket halves have corresponding interleaving tabs adapted to reduce lateral movement of the first and second bracket halves when the first and second bracket halves move relative to each other.

8. The catch fence system of claim 1, wherein the mounting bracket includes a mounting plate and each lower front member having a mounting collar adapted to be removably coupled to the mounting plate, wherein the mounting collar may be affixed to the mounting plate in different positions so as to change an orientation of the lower front member relative to the race track.

9. The catch fence system of claim 8, wherein the mounting plate has a plurality of holes and the mounting collar has a corresponding plurality of holes, each of the holes adapted to receive a fastener to secure the mounting collar to the mounting plate.

10. The catch fence system of claim 1 further comprising a bracing member extending between and affixed to the first and second frame members.

11. A catch fence system for use at a race track having a retaining wall bordering at least a portion of the race track, comprising:

first and second frame members spaced apart from each other, each of the first and second frame members has a lower front member with a mounting bracket adapted to connect the lower front member to the retaining wall, the mounting bracket having first and second bracket halves configured to slidingly move with respective to each other to accommodate retaining walls with different thicknesses;

first and second support rings, the first support ring being affixed to the lower front member of the first frame member, and the second support ring being affixed to the lower front member of the second frame member;

a first front cable extending between and slidingly through the first and second support rings;

first and second stop blocks, the first stop block affixed to the first front cable to the outside of the first support ring, and the second stop block affixed to the first front cable to the outside of the second support ring; and a front fence extending between each lower front member and affixed to the first front cable.

12. The catch fence system of claim 11, wherein the first and second bracket halves have corresponding interleaving tabs adapted to reduce lateral movement of the first and second bracket halves when the first and second bracket halves move relative to each other.

13. The catch fence system of claim 11, wherein the mounting bracket includes a mounting plate and each lower front member having a mounting collar adapted to be removably coupled to the mounting plate, wherein the mounting collar may be affixed to the mounting plate in different positions so as to change an orientation of the lower front member relative to the race track.

14. The catch fence system of claim 13, wherein the mounting plate has a plurality of holes and the mounting collar has a corresponding plurality of holes, each of the holes adapted to receive a fastener to secure the mounting collar to the mounting plate.

15. The catch fence system of claim 11, wherein the first stop block is positioned along the first front cable a distance L1 from the first support ring and the second stop block is positioned along the first front cable a distance L2 from the second support ring, wherein the distance L2 is greater than the distance L1.

16. A catch fence system for use at a race track having a retaining wall bordering at least a portion of the race track, comprising:

first and second frame members spaced apart from each other, each of the first and second frame members has a lower front member and a rear member, the lower front member having a mounting bracket adapted to connect the lower front member to the retaining wall, the rear member adapted to be connected to a support surface, the mounting bracket includes a mounting plate and each lower front member having a mounting collar adapted to be removably coupled to the mounting plate, first and second support rings, the first support ring being affixed to the lower front member of the first frame member, and the second support ring being affixed to the lower front member of the second frame member;

a first front cable extending between and slidingly through the first and second support rings;

first and second stop blocks, the first stop block affixed to the first front cable to the outside of the first support ring, and the second stop block affixed to the first front cable to the outside of the second support ring; and a front fence extending between each lower front member and affixed to the first front cable, wherein the mounting collar may be affixed to the mounting plate in different positions so as to change an orientation of the lower front member relative to the race track.

17. The catch fence system of claim 16, wherein the mounting plate has a plurality of holes and the mounting collar has a corresponding plurality of holes, each of the holes adapted to receive a fastener to secure the mounting collar to the mounting plate.

18. The catch fence system of claim 16, wherein the first stop block is positioned along the first front cable a distance L1 from the first support ring and the second stop block is positioned along the first front cable a distance L2 from the second support ring, wherein the distance L2 is greater than the distance L1.

19. The catch fence system of claim 16, wherein each of the first and second frame members has an upper front member, the catch fence system further comprising:

third and fourth support rings, the third support ring being affixed to the upper front member of the first frame member, and the fourth support ring being affixed to the upper front member of the second frame member;

a second front cable extending between and slidingly through the third and fourth support rings; and third and fourth stop blocks, the third stop block affixed to the second front cable to the outside of the third support ring, and the fourth stop block affixed to the second front cable to the outside of the fourth support ring;

wherein the front fence extends between each upper front member and is affixed to the second front cable; and wherein the third stop block is positioned along the second front cable a distance L1 from the third support ring and the fourth stop block is positioned along the second front cable a distance L2 from the fourth support ring, wherein the distance L2 is greater than the distance L1.

* * * * *